US008813536B2

(12) United States Patent
Swanson

(10) Patent No.: US 8,813,536 B2
(45) Date of Patent: Aug. 26, 2014

(54) SYSTEM AND METHOD FOR REMOVING DENTS FROM A DENTED SURFACE

(75) Inventor: Daniel C. Swanson, Lombard, IL (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 470 days.

(21) Appl. No.: 13/220,923

(22) Filed: Aug. 30, 2011

(65) Prior Publication Data

US 2013/0047694 A1 Feb. 28, 2013

(51) Int. Cl.

| | |
|---|---|
| ***B21D 13/02*** | (2006.01) |
| ***B25B 33/00*** | (2006.01) |
| ***B25D 17/00*** | (2006.01) |
| ***B21D 1/06*** | (2006.01) |

(52) U.S. Cl.

CPC ..... *B21D 1/065* (2013.01); *Y10S 72/705* (2013.01)

USPC ..... 72/453.16; 72/375; 72/446; 72/705; 173/122; 173/205; 173/217

(58) Field of Classification Search

CPC ..... B21D 1/06; B21D 13/02; B25B 33/00; H01R 43/0425; B21J 13/085

USPC ..... 173/122, 162.2, 170, 217; 72/375, 441, 72/446, 456, 447, 453.16, 453.17, 705

See application file for complete search history.

(56) References Cited

U.S. PATENT DOCUMENTS

| | | | | |
|---|---|---|---|---|
| 1,940,738 | A * | 12/1933 | Anderson | 72/456 |
| 1,957,495 | A * | 5/1934 | Fleming | 72/375 |
| 1,982,667 | A * | 12/1934 | Hopkins | 72/441 |
| 2,054,248 | A * | 9/1936 | Eronen | 72/447 |
| 2,545,904 | A * | 3/1951 | Taylor | 72/446 |
| 5,119,667 | A * | 6/1992 | Hollis et al. | 72/453.16 |
| 8,485,276 | B2 * | 7/2013 | Wei | 173/217 |

* cited by examiner

*Primary Examiner* — David B Jones

(74) *Attorney, Agent, or Firm* — McAndrews, Held & Malloy, Ltd.

(57) ABSTRACT

Described herein is technology for, among other things, removing a dent from a dented surface. The technology includes an automated hammering device positioned on a first side of the dent, and a dolly positioned on a second side of the dent. The automated hammering device repeatedly strikes the dent, thereby restoring proper curvature to the dented surface.

8 Claims, 3 Drawing Sheets

SYSTEM AND METHOD FOR REMOVING DENTS FROM A DENTED SURFACE

BACKGROUND

1. Field

The present invention generally relates to the removal of dents from dented surfaces.

2. Background

Vehicle repair technicians are constantly seeking ways to more efficiently and effectively remove dents from the bodies and fenders of such vehicles. Traditionally, such repairs are carried out by striking the indented portion of the body or fender with a hammer or mallet while bracing the opposite side of the dent with a dolly to prevent denting in the opposite direction.

This traditional method has drawbacks, however. Body curvatures can often create complications based on a dent's location, either because the size of the target hit point is small or because the dent is in a tight space that allows little room for error. Moreover, a hammer or mallet's swinging action invariably creates difficulties because swinging a hammer or mallet often leads to errors in making direct and consistent contact with the target hit point.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Described herein is technology for, among other things, removing a dent from a dented surface. The technology includes an automated hammering device positioned on a first side of the dent, and a dolly positioned on a second side of the dent. The automated hammering device repeatedly and automatically strikes the dent, thereby restoring proper curvature to the dented surface A better appreciation of the advantages, features and properties of the system and method disclosed below will be obtained from the following detailed description and accompanying drawings which set forth the manner in which the invention may be employed.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Figure 1:
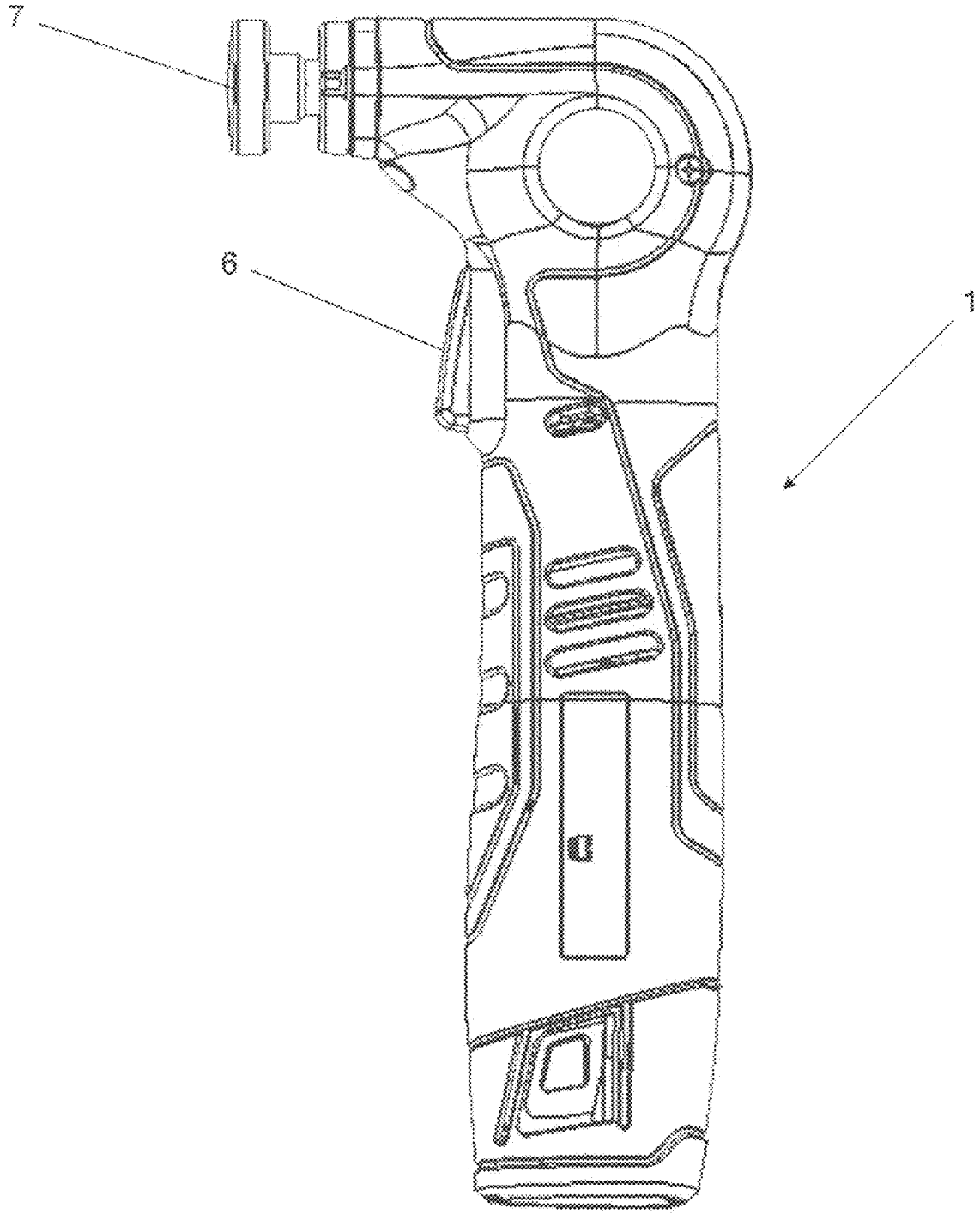
FIG. 1 is a perspective view of an automated hammering device, including a striking member for use in removing dents, in accordance with an embodiment of the present invention.

FIG. 1 shows an automated hammering device 1 having a trigger 6, in accordance with various embodiments of the present invention. The general structure and operation of an automated hammering device is shown and described in U.S. Pat. Nos. 7,789,282 and 7,963,430, which are incorporated herein by reference. The automated hammering device 1, according to an embodiment, includes an elongate striking member 7, which strikes the dent to be removed (not shown in FIG. 1). To operate the automated hammering device 1, a user depresses the trigger 6, which causes the striking member 7 to reciprocate, thus providing the repetitive striking force necessary to remove a dent (not shown in FIG. 1).

Figure 2:
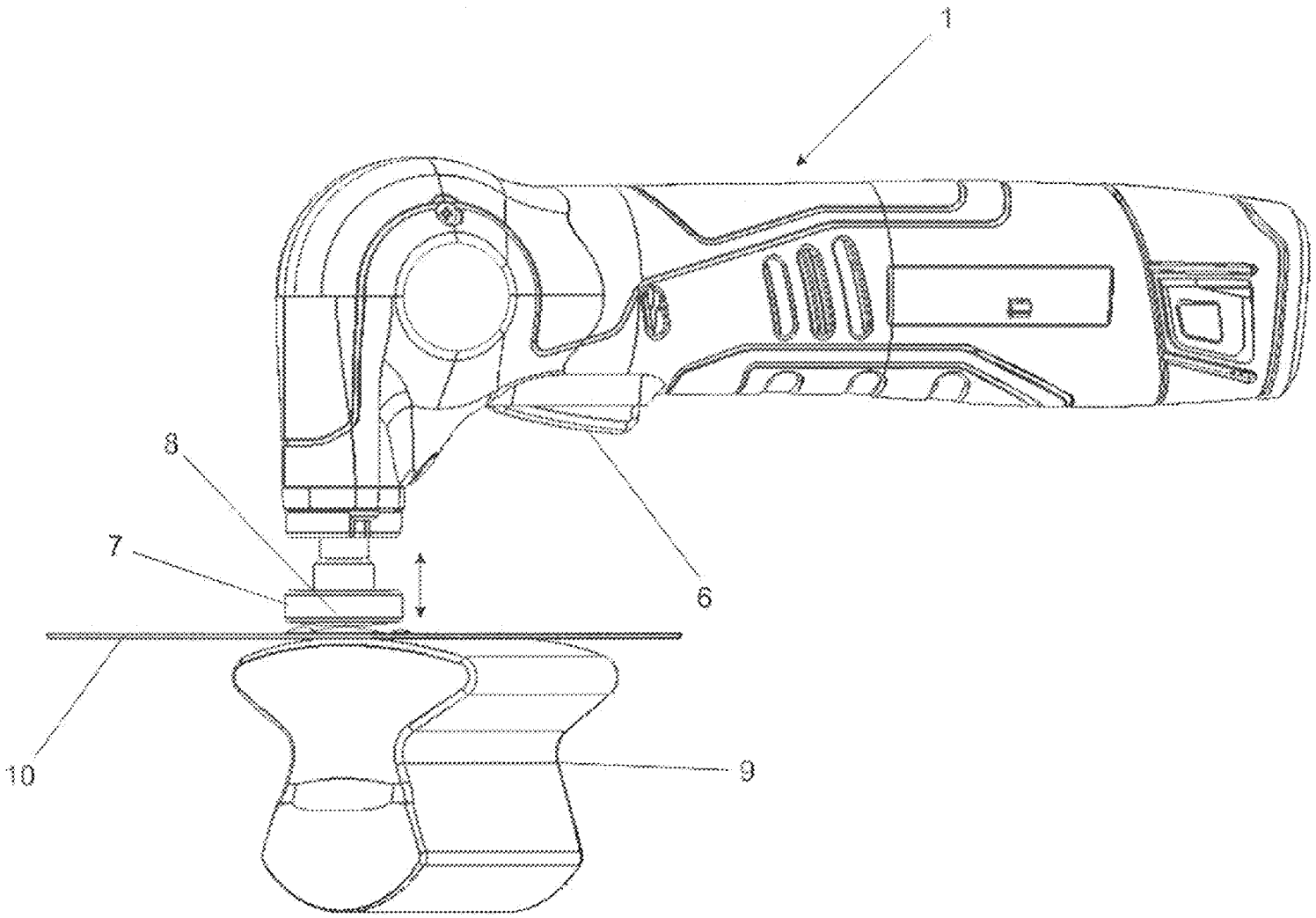
FIG. 2 is side view of an automated hammering device working in conjunction with a dolly to remove a dent from a dented surface, in accordance with an embodiment of the present invention.

FIG. 2 is a side view of an automated hammering device 1 being used to remove a dent 8 from a dented surface 10 in accordance with an embodiment of the present invention. As shown, the dent has a first side and a second side corresponding to a convex side and a concave side, respectively. The automated hammering device 1 includes a striking member 7, which is intended to make direct contact with a dent 8 located on a dented surface 10. In one embodiment, the striking member 7 may be selectively removable from the automated hammering device 1. Accordingly, the striking member 7 may also be one of several interchangeable bits of differing sizes and shapes to be used for different surfaces or dents. Specifically, the automated hammering device 1 may be outfitted with a striking member 7 having a flat, curved or convex surface, depending on the type of material comprising the dented surface 10 and the shape or size of the dent 8.

A dolly 9 is positioned on the side of the dented surface 10 opposite the automated hammering device 1, to restore the proper curvature to the dented surface 10 and to eliminate the possibility of the automated hammering device 1 creating new dents in the surface 10 in the opposite direction. Moreover, the dolly 9 is sized for holding in one hand, and the sides of the dolly 9 may be concave and/or coated in a material to facilitate gripping. It should be appreciated that the dented surface 10 as shown in FIG. 2 is intended to generally represent any dented surface sought to be repaired. To remove the dent 8, a technician may position the automated hammering device 1 on the dent 8, position the dolly 9 on the opposite side of the dented surface 10, and press the trigger 6, which will cause the striking member 7 to reciprocate, thereby restoring proper curvature to the dented surface 10.

Figure 3:
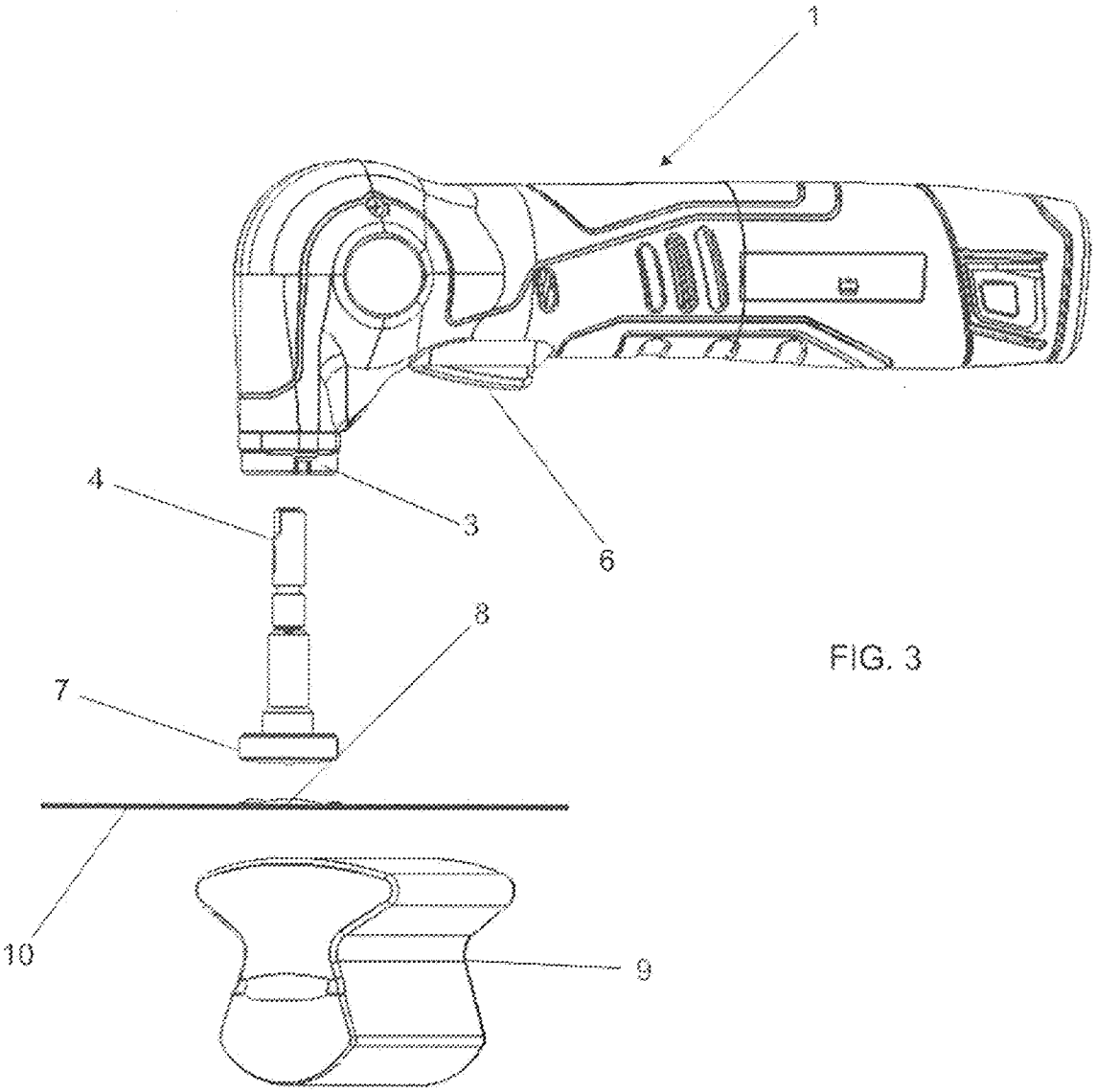
FIG. 3 is an exploded view of an automated hammering device as in FIG. 2, in accordance with an embodiment of the present invention, showing how the various elements of the system described herein interact to remove a dent from a dented surface.

FIG. 3 shows an exploded view of an embodiment, including an automated hammering device 1 having a trigger 6 and a striking member 7. The striking member 7 is intended to make direct contact with a dent 8 located on a dented surface 10. The system further comprises a dolly 9 positioned on the side of the dented surface 10 opposite the automated hammering device 1, with the dolly providing support to restore the proper curvature to the dented surface 10, while also eliminating the possibility of the automated hammering device 1 creating new dents in the dented surface 10 in the opposite direction.

The automated hammering device 1 further comprises a nozzle portion 3, which is capable of receiving the stem 4 of the striking member 7, with the stem 4 being sized to fit into the nozzle portion 3. In one embodiment, the nozzle portion 3 contains a magnet and the stem 4 contains ferromagnetic material, so that the stem 4 is held in place when inserted into the nozzle portion 3 of the automated hammering device 1. In another embodiment, the striking member 7 may be replaceable, for example, with the stem 4 and nozzle portion 3 each being threaded so that one may be screwed into the other.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A system for removing a dent from a dented surface, the dent having a first side and a second side opposite the first side, the system comprising:

an automated hammering device comprising:

a nozzle portion, and a reciprocating striking member operable to strike the first side of the dent, the reciprocating striking member extending from the nozzle portion, and the reciprocating striking member comprising a stem that is detachably coupled to the nozzle portion; and a handheld dolly comprising a concave gripping surface, the handheld dolly operable to brace the second side of the dent, wherein the automated hammering device and the handheld dolly cooperate to substantially remove the dent from the dented surface.

2. The system as in claim 1, wherein the first side of the dent is a convex side of the dent.

3. The system as in claim 1, wherein the second side of the dent is a concave side of the dent.

4. The system as in claim 1, wherein the nozzle portion comprises a magnet and the stem comprises ferromagnetic material such that the stem is held in place when inserted into the nozzle portion.

5. The system as in claim 1, wherein the stem of the reciprocating striking member and the nozzle portion are threaded to detachably couple the stem to the nozzle portion.

6. A method for removing a dent from a dented surface with a handheld dolly and an automated hammering device having a nozzle portion and a reciprocating striking member comprising a stem detachably coupleable to the nozzle portion and extending therefrom, the dent having a first side and a second side opposite the first side, the method comprising:

detachably coupling the stem of the reciprocating striking member to the nozzle portion;

positioning the reciprocating striking member on the first side of the dent;

positioning the handheld dolly on the second side of the dent, the handheld dolly operable to brace the second side of the dent, the handheld dolly comprising a concave gripping surface; and operating the automated hammering device so as to repeatedly strike the dent, the automated hammering device and the handheld dolly cooperating to substantially restore proper curvature to the dented surface.

7. The method as in claim 6, wherein the reciprocating striking member is one of a plurality of interchangeable striking members, each of the plurality of interchangeable striking members detachably coupleable to the nozzle portion.

8. The method as in claim 6, wherein each of the plurality of interchangeable striking members comprises one of:

a flat striking surface, a curved striking surface, and a convex striking surface.

* * * * *